United States Patent [19]

Blotenberg

[11] 4,362,462

[45] Dec. 7, 1982

[54] METHOD OF INTERMEDIATE COOLING OF COMPRESSED GASES

[75] Inventor: Wilfried Blotenberg, Oberhausen, Fed. Rep. of Germany

[73] Assignee: M.A.N. Uternehmensbereich G.H.H. Sterkrade, Fed. Rep. of Germany

[21] Appl. No.: 129,238

[22] Filed: Mar. 11, 1980

[30] Foreign Application Priority Data

Mar. 12, 1979 [DE] Fed. Rep. of Germany ..... 2909675

[51] Int. Cl.[3] ..... F04D 29/58

[52] U.S. Cl. ..... 415/1; 415/179; 417/243

[58] Field of Search ..... 415/1, 3, 47, 179; 417/243

[56] References Cited

U.S. PATENT DOCUMENTS 1,400,813 12/1921 Graemiger ..... 415/1

3,795,458 3/1974 Strub ..... 415/179

3,947,146 3/1976 Schuster ..... 415/1

FOREIGN PATENT DOCUMENTS 2132141 1/1973 Fed. Rep. of Germany ..... 417/243

2113038 1/1975 Fed. Rep. of Germany .

*Primary Examiner*—Louis J. Casaregola

*Attorney, Agent, or Firm*—McGlew and Tuttle

[57] ABSTRACT

An improved method of cooling compressed gases intermediate successive compressive stages in a multistage intercooled compressor system without forming condensate is provided. Cooling water flow to an intercooler intermediate successive compressive stages is regulated as a function of the actual temperature of the gas downstream of the intercooler and a set point temperature generated as a function of a linear approximation relating the inlet dew point temperature and the pressure of the gases downstream of the intercooler.

1 Claim, 2 Drawing Figures

RELATIONSHIP BETWEEN PRESSURE AND DEWPOINT TEMPERATURE
DEW POINT TEMPERATURE (in °C)
$t_2$
60
50
40
30
20
10
0
$P_2$ PRESSURE in BAR
5
4.5
4
3.5
3
2
1
$P_2$ =0
EXACT VARIATION
APPROXIMATE VARIATION
0
10
20
30
INITIAL AIR TEMPERATURE (in °C)
$t_a$

CONTROLLER
CONTROLLER
HUMIDITY SENSOR
PT
TS
TT
M
$b_i \times P_2$
$b_i \times P_1$
$a_2 \times t$
$a_1 \times t$
$c_2$
$c_1$
$t_a$
10
12
14
16
18
20
22
26
28
30
32
34
36
38
40
42
44
46
48
50
52
54
56
58
60
62
64

METHOD OF INTERMEDIATE COOLING OF COMPRESSED GASES

BACKGROUND AND FIELD OF THE INVENTION

The invention relates, in general to a method of intermediate cooling of compressed gases in turbocompressor systems without forming condensate and, more particularly, to an improved method and arrangement of cooling compressed air intermediate successive compressor stages in a multi-stage intercooled compressor system.

To obtain an optimum efficiency, gases are compressed under isothermal conditions. To this end, it is desirable to largely dissipate the compression heat contained in the gas by means of indirect cooling in gas coolers provided between the individual compression stages. Care must be taken to prevent the temperature of the gas in the intermediate coolers from dropping below the dew point, i.e., below the temperature at which the humid gas at the given pressure level is saturated with water vapor.

In the event that the vapor pressure drops below the dew point temperature, the gases taken in along with the air, such as $SO_2$, $SO_3$, $CO_2$ and $NH_2$, unite with condensed water vapor to form acids and bases which can cause corrosion along their path, on impellers, seals, in the intermediate coolers and the like.

The water condensate droplets entrained with the air stream, moreover, can cause cavitation damage to the impellers of the compressors, which results, for example, in an erosion of the sensitive impeller blades.

The condensate droplets, in addition, can carry dirt particles and corrosion products. Partial evaporation of these droplets during their flow to the next cooling stage leads to the deposition of the dirt particles and corrosion products primarily on the hot walls of the impellers and the distributors. The resulting deposits reduce the cross-sectional area of the flow channels and, thereby, detrimentally affect the performance of the compressor. Dirt deposits on impellers, moreover, may cause strong imbalances which, as is well known, lead to damage during turbo-compressor operations.

To prevent the temperature of the cooled gas from dropping below the dew point, it has been usual to manually control the temperature in the intermediate cooler in accordance with tables, by varying the coolant flow to the cooler.

German patent document No. AS 1 428 047 discloses for example, a control system in which a differential temperature is determined for each compressor stage, computed from the intake temperature of the fluid entering a compression stage and the dew point temperature of this fluid after its exit from the compressor stage. This temperature provides the set point at a continuous control value. However, even such a control system has drawbacks which cannot be overlooked. First, the intermediate cooler temperature cannot be controlled continuously but must be continually adjusted as a function of the variation in time of the intake temperature. Secondly, selection of the differential temperature set point in accordance with the expected maximum intake temperature has the disadvantage that, at a lower actual intake temperature, the adjusted temperature of the intermediate cooler will be too high. This means, that the efficiency of the compressor would be reduced. If, on the other hand, the actual intake temperature exceeds the expected maximum value, the temperature will fall short the dew point temperature, the intake capacity of the compressor will initially be reduced and damage, as noted above, will occur.

Another method of controlling a condensate-free intermediate cooling of compressed gases is known from German patent document No. AS 1 428 033. According to the method disclosed, the temperature of the intermediate cooler is kept above the local dew point temperatures of the gas. This method also has uncontrollable drawbacks. First, extraordinarily large cooling surfaces are needed, since the differential temperature between the gas and the cooling surfaces diminishes as the gas temperature approaches the desired temperature. Second, an adaptation of conventional compressors to this prior art method is extremely difficult if not impossible. Third, at higher cooling water temperatures, the coolers must be operated with purified water, to prevent calcereous deposits in the coolers. Finally, condensate formation cannot always be prevented with this method.

In addition, the two prior art control methods, discussed above, have the disadvantage that the dew point must be determined and introduced into the measuring operation after each cooling stage. With a plurality of coolers, higher static pressures, and higher flow velocities, this becomes considerably expensive.

Another method, disclosed by German patent document No. AS 2 113 038, for example, allows computation of the temperatures in the intermediate coolers of the gas to be compressed, however, since this prior art method measures the intake temperature and is based on a relative humidity of 100%, the computed temperature values are not sufficiently exact to obtain optimum measured values. In addition, in such a method, the fairly considerable effect of the cooler pressure is neglected. As a consequence, at operating pressures below the maximum possible cooler pressure and with relative intake humidities below 100%, the determined temperatures are too high to a considerable extent. The efficiency of the unit is therefore lower than the possible maximum.

SUMMARY OF THE INVENTION

The invention is directed to an improved method and arrangement which permits the computation and adjustment of the temperature of each of the intermediate coolers almost exactly and in an inexpensive way, so as to eliminate the drawbacks resulting from falling below the dew point temperatures but still to preserve an optimum efficiency of the compressor unit. This is obtained, in accordance with the invention, by providing that the humidity of the gas to be compressed is measured at the suction side of the first compression stage and the temperature and pressure are measured at the suction side of each following compression stage, and the measured values are processed by means of a control system on the basis of the following equations:

$$T_i = a_i \cdot \tau_a + b_i \cdot p_i + c_i$$

In practice, the constants $a_i$, $b_i$ and $c_i$, which are of the order of magnitude of 1 to 5, may be introduced by means of conventional control systems, by multiple addition of the measured values to one another and following reduction in a voltage divider.

Accordingly, it is an object of the invention to provide in a multi-stage intercooled compressor system, an improved method of cooling compressed gases intermediate successive compressor stages without forming condensate comprising measuring the humidity of the gases to be compressed at the suction side of the first compression stage, measuring the temperature and pressure of the compressed gases at the suction side of a successive compressive stage designate $_i$, generating a set point temperature signal on the basis of the equation $$T_i = a_i \tau_a + b_i p_i + c_i$$

where $\tau_a$ is the dew point temperature of the gases at the suction side of the first compression stage, $P_i$ is the pressure of the compressed gases at the suction side of a successive compressive stage designated $_i$, and $a_i$, $b_i$ and $c_i$ are constants, and then generating a control signal for controlling the cooling of the compressed gases between the successive compressive stages as a function of the set point temperature signal and the temperature of the compressed gases at the suction side of the compressive stage designated $_i$.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION

Figure 1:
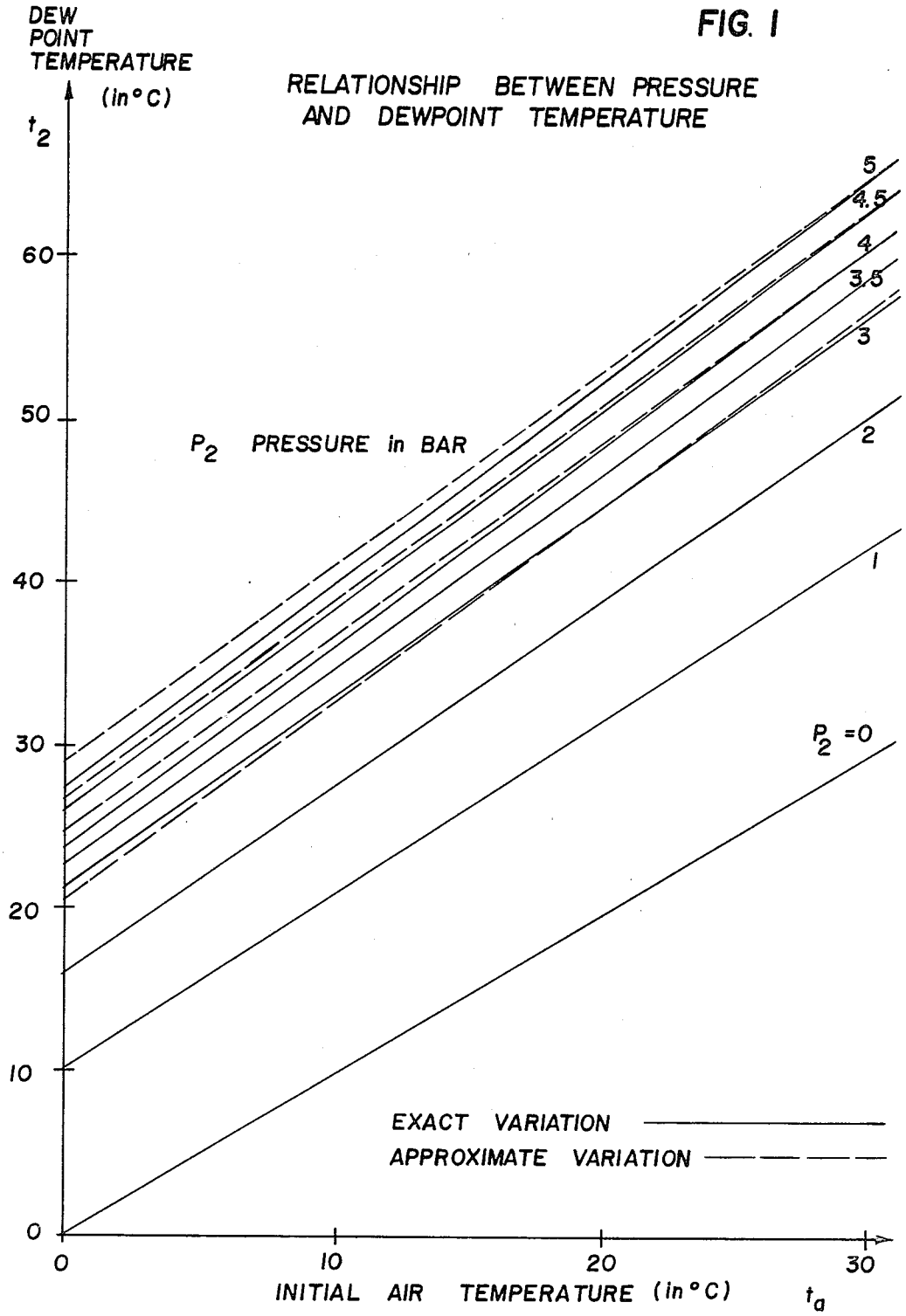
FIG. 1 is a diagrammatic representation illustrating the dew point temperature $\tau_2$ at the suction side of the second compression stage as a function of the dew point temperature of the initial suction or inlet gas $\tau_a$, for different pressures (the actual variations and the approximations underlying the invention are shown)

Referring to the drawings in particular, the invention embodied therein comprises an improved method of drying compressed air intermediate successive compressor stages of a multi-stage intercooled compressor system.

As used herein, the subscript a indicates the initial state of the inlet or suction gas to be compressed upstream of the first compression stage and subscript i indicates the number of the stage of compression following the first one. The atmosphere is a mixture of water vapor and air. Humid air, at temperatures ranging up to about 60° C. and pressures ranging up to 10 bar, may safely be considered to be an ideal gas mixture of air and water vapor. Then, the following relation applies:

$$P_{Di} = P_{Da} \cdot P_i / P_a \quad (1)$$

with $P_{Di}$ and $P_i$, respectively, being the vapor pressure and total pressure directly upstream of compression stage i and $P_{Da}$ and $P_a$, respectively, being the vapor pressure and total pressure of the initial inlet or suction air.

To determine the dew point at the pressure $P_2$ it is necessary to know dew point temperature $\rho_1$ at the pressure $P_1$. The respective partial (vapor) pressure $P_{D1}$ is read from a vapor pressure curve, and the partial (vapor) pressure $P_{D2}$ is then computed from relation (1) so that the dew point temperature $\rho_2$ from the respective point on the vapor pressure curve may be obtained.

It will be surprising to those skilled in the art that the dew point temperature $\rho_i$ at any stage of compression can be defined with a satisfactory accuracy by the following linear approximation:

$$\tau_i = a_i \tau_a + b_i P_i + C_i \quad (2)$$

Since the desired cooler temperature achieved by an intercooler is to exceed the dew point with an approximate margin of safety, the desired temperature $T_i$ may be derived from the relation $$T_i = a_{i \cdot \tau a} + b_i P_i + c_i \quad (3)$$

The linear approximation makes it unnecessary to take into acount absolute temperatures. As an example with an approximate range of $\tau_a$32 0 to 30° C. and $P_i$=4 to 6 bar, maximum errors of 1.5° C. are to be expected.

FIG. 1 graphically compares the relation between the exact and the approximate variations.

Figure 2:
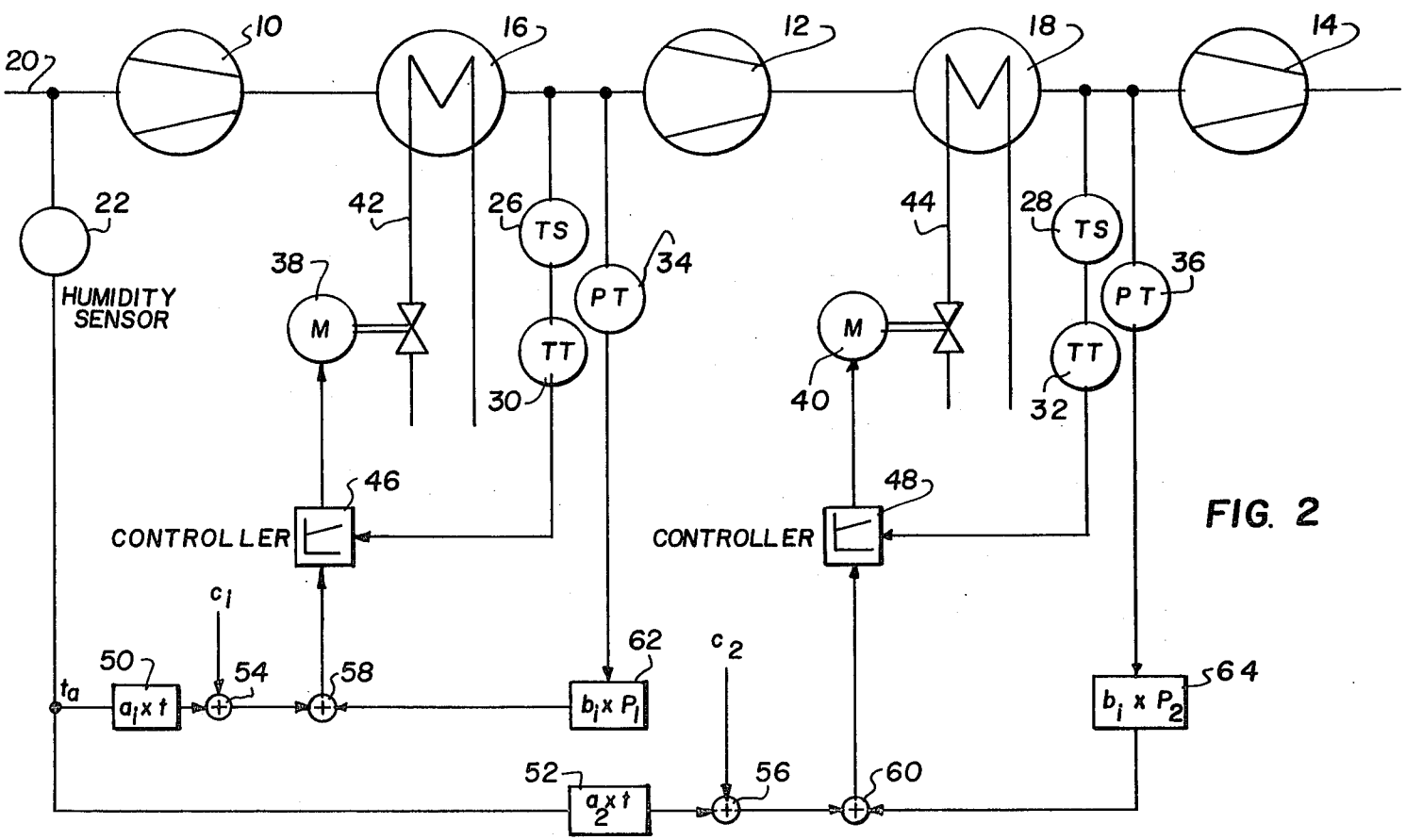
FIG. 2 is a control diagram of an arrangement for carrying out the inventive method.

FIG. 2 illustrates a control arrangement for carrying out the inventive technique. In FIG. 2, a multi-stage compressor system having three successive compressive stages 10, 12, 14 are shown. Intercoolers 16, 18 are provided between the successive compressive stages, that is, intercooler 16 is located dowstream of compressive stage 10 and intercooler 18 is likewise provided downstream of compressive stage 12 but upstream of compressive stage 14. The initial condition of the inlet or suction gas at 20 is monitored by a humidity sensor 22. A temperature sensor 26, 28 is disposed downstream of each intercooler 16,18 respectively, to sense the temperature of the cooled gas. A temperature transducer 30,32 is respectively associated with each of the temperature sensors 26, 28 to generate a signal corresponding to the sensed temperature. In addition, a pressure transducer 34,36 is provided for sensing the pressure downstream of each intercooler 16, 18 respectively and generating an associate signal corresponding to the pressure. The intercooler may be of a conventional type of indirect heat exchanger, for example, a shell and tube arrangement utilizing a flow of cooling water to cool the compressed gas. As shown in FIG. 2, a control valve 38,40 is associated with a respective cooling circuit 42, 44 of each intercooler 16, 18, to control the flow of the coolant responsive to a signal received from a respective controller 46,48 and thus act as adjustment means for each compression stage.

The signal generated by the respective controller 46,48 is formed as a function of the difference between the actual gas temperature value downstream of the associated intercooler and the desired value determined in accordance with the linear approximation described by the formula (3) above. The temperature transducer 30, 32 generates a signal corresponding to the actual value of the temperature. As shown in FIG. 2, humidity sensor 22 generates a signal which is converted in a respective multiplier 50,52 as a function of constant $a_i$ and subsequently added in a first respective summing unit 54,56, to a signal which is representative of constant $c_i$, and then added with a signal received from a respective multiplier 62,64 representative of the product of the signal generated by pressure transducer 34,36 and constant $b_i$, in a second summing unit 58, 60 to form the desired value or set point signal which is fed to the respective controller 46,48 which in turn, controls the cooling water regulating valve 38,40 which in turn, controls the cooling water regulating valve 38,40 so as to vary the temperature of the gases leading to the next successive compressive stage.

The inventive method makes it possible to control the temperature of the gas in the intercooler of multi-stage gas compressors in a simple way such that the range of application of the compressor unit is not restricted, the intake capacity is preserved, and a long-term corrosion-free operation is ensured. The control is reliably and inexpensively effected by a linearization in the working range. Therefore, the solution of the underlying problem may be qualified as outstanding.

While a specific embodiment of the invention has been shown and described in detail to illustrate the application of the principles of the invention, it will be understood that the invention may be embodied otherwise without departing from such principles.

What is claimed is:

1. In a multi-stage intercooled compressor system having a plurality of compression stages connected in series with a cooling unit controlled by adjustment means between each stage, an improved method of cooling compressed gases intermediate the stages without forming condensate comprising:

measuring the absolute humidity of the gases to be compressed at the suction side of a first compression stage which corresponds to a dew point $\tau$ of the gases at the suction side of the first compression stage;

measuring the temperature and pressure of the compressed gases at the suction side of a successive compression stage designated i;

generating a set point temperature signal on the basis of the linear equation $$T_i = a_i \cdot \tau_a + b_i \cdot P_i + c_i$$

where $P_i$ is the pressure of the compressed gases at the suction side of the successive compression stage designated i, and $a_i$, $b_1$ and $C_i$ are constants;

generating a control signal for controlling the cooling of the gases upstream of the compression stage designated i as a function of the set point temperature signal and the actual temperature of the compressed gases at the suction side of the compression stage designated i; and using the control signal to control the adjustment signal to control the adjustment means of the cooling unit which is upstream of the compression stage designated i.

* * * * *